US005531657A

United States Patent [19]

Macedo

[11] Patent Number: 5,531,657

[45] Date of Patent: Jul. 2, 1996

[54] MODULAR AQUATIC EXERCISE EQUIPMENT ASSEMBLY

[75] Inventor: Antone Macedo, Manville, R.I.

[73] Assignee: ERO Industries, Inc., Mt. Prospect, Ill.

[21] Appl. No.: 335,893

[22] Filed: Nov. 8, 1994

[51] Int. Cl.[6] ..... A63B 21/075

[52] U.S. Cl. ..... 482/111; 482/106; 482/108

[58] Field of Search ..... 482/106, 107, 482/108, 111

[56] References Cited

U.S. PATENT DOCUMENTS

| | | |
|---|---|---|
| D. 244,628 | 6/1977 | Wright . |
| D. 244,629 | 6/1977 | Wright . |
| D. 279,919 | 7/1985 | Bedgood . |
| D. 309,763 | 8/1990 | Solloway . |
| 373,692 | 11/1887 | Shaaber . |
| 2,009,551 | 3/1935 | Huebner . |
| 3,052,897 | 9/1959 | Martin . |
| 3,424,133 | 1/1967 | Brady . |
| 3,589,721 | 6/1971 | Cronauer . |
| 3,786,526 | 1/1974 | Ausseil . |
| 4,029,312 | 6/1977 | Wright . |
| 4,059,265 | 11/1977 | Wieder et al. . |
| 4,311,306 | 1/1982 | Solloway . |
| 4,411,422 | 10/1983 | Solloway . |
| 4,416,451 | 11/1983 | Solloway . |
| 4,458,896 | 7/1984 | Solloway . |
| 4,480,829 | 11/1984 | Yacoboski . |
| 4,521,011 | 6/1985 | Solloway . |
| 4,565,369 | 1/1986 | Bedgood . |
| 4,603,854 | 8/1986 | Krausz . |
| 4,623,142 | 11/1986 | MacKechnie . |
| 4,627,613 | 12/1986 | Solloway . |
| 4,632,387 | 12/1986 | Guzman . |
| 4,673,179 | 6/1987 | Pengler . |
| 4,685,667 | 8/1987 | McDonald . |
| 4,733,861 | 3/1988 | Plunkett, III . |
| 4,819,951 | 4/1989 | Solloway . |
| 4,896,880 | 1/1990 | Caruthers ..... 482/108 |
| 4,988,094 | 1/1991 | Beasley . |
| 5,033,739 | 7/1991 | MacKechnie . |
| 5,131,650 | 7/1992 | Hall . |
| 5,184,993 | 2/1993 | Dowdeswell . |
| 5,190,512 | 3/1993 | Curran . |
| 5,203,753 | 4/1993 | Rothhammer . |
| 5,266,069 | 11/1993 | Thorne . |

FOREIGN PATENT DOCUMENTS

| | | |
|---|---|---|
| 0007290 | of 1899 | United Kingdom ..... 482/106 |

*Primary Examiner*—Lynne A. Reichard

*Attorney, Agent, or Firm*—Lockwood, Alex, Fitzgibbon & Cummings

[57] ABSTRACT

A modular aquatic exercise equipment assembly for use by a person in water comprises a gripping bar with water resistance members removeably fixed on opposite ends thereof. Each water resistance member comprises a pair of interlocking components having a shaft portion and a planar fin water resistance portion, the two portions having slots for engaging each other so that the components lie substantially flat and when assembled, the two components are interlocked and present a plurality of planar fin water resistance surfaces which extend radially outwardly from the shaft portion.

22 Claims, 2 Drawing Sheets

MODULAR AQUATIC EXERCISE EQUIPMENT ASSEMBLY

BACKGROUND OF THE INVENTION

The present invention relates to an exercise assembly, and more particularly, to a modular exercise assembly intended for use in water.

The past few years have seen an increase in the awareness of individuals of their physical well-being and stamina. The benefits of exercise have been highly publicized and the exercise market has increased tremendously as a result of this publicity and awareness. Exercise may take a variety of forms, and includes cardiovascular exercise such as jogging, running or cycling, or it may include traditional weight or resistance training such as weightlifting. Whereas cardiovascular exercise typically improves endurance, weight or resistance training builds up or strengthens particular aspects of an individual's body. The present invention is primarily directed to this latter category of exercise.

Weight training usually requires a barbell shaft and a plurality of different weighted elements which are held on the ends of the barbell shaft by retaining collars or the like. The user lifts, or otherwise moves, the barbell between at least two preselected positions for a predetermined number of repetitions. A user may perform a large number of repetitions at a moderate weight to tone specific body areas, or the user may perform a number of repetitions with maximum weight until failure in order to build up strength in his particular muscles.

Resistance training is similar to weight training in that it requires a user to perform repetitions. However, instead of using static weights, the user typically pushes or pulls against a resistance force of an exercise machine which may be supplied by rubber or elastic bands. Although weight and resistance training are generally effective methods of physical conditioning, they are not without certain disadvantages. For example, weight training necessitates that a user keep a large number of weights on hand. The weights are bulky and heavy in nature and are not easily stored or transported. Additionally, most weight training exercises require the presence of a spotter, who is another individual who is available to assist the user in case of trouble. Also, both resistance and weight training tend to impart, dependent on the particular exercise, undue stress on the user's joints. Resistance training not only requires a machine, but also necessitates replacement of the resistance bands as they wear down over time.

Hydrodynamic exercises, where the user is partially immersed in water and uses the water as a weight or resistance medium, has been recognized as providing comparable benefits to weight or resistance training while eliminating the detrimental stress on the joints of the user. Hydrodynamic exercise includes either the user lifting or pushing one of his limbs, such as an arm or leg against the water in a repetitive movement or the user manipulating an exercise device in the water in a repetitive manner. These hydrodynamic exercise devices are well known in the art and include, for example, barbells having one or more foam rubber elements which the user pushes or pulls against the resistance of the water as disclosed in U.S. Pat. No. 5,188,993, issued Feb. 9, 1993. Hydrodynamic exercise devices may also include a barbell or dumbbell having plurality of planar fin-or blade-like members which the user pushes and/or pulls against the water, such as those disclosed in either U.S. Pat. No. 4,623,142, issued Nov. 18, 1986 or U.S. Pat. No. 4,819,915, issued Apr. 11, 1989.

These types of hydrodynamic exercise equipment are easy to use and relatively simple in design and construction. However, the blades or fins which provide the water resistance surface(s) for the exercise device typically extend radially outwardly from a shaft at different angles. These extensions render the exercise equipment bulky and cumbersome for transport and storage. Heretofore, no one has provided aquatic exercise equipment which is modular in nature which may be easily disassembled for component storage and transport, and which may be assembled in a minimum amount of time.

It is therefore an object of the present invention to provide a modular aquatic exercise equipment assembly in which the exercise equipment assembly may be easily disassembled and which requires a minimum of space for storage and transport.

Another object of the present invention is to provide an improved hydrodynamic exercise equipment component having a user-engageable shaft and two water-resistance members removeably attached thereto at opposite ends of the shaft, each of the water-resistance members including planar fins which radially extend outwardly therefrom in different radial directions, and each of the water-resistance members including a hand grip portion interposed between the fins.

Yet another object of the present invention is to provide a set of components for a modular assembly of aquatic exercise equipment which may be quickly assembled together to form an aquatic exercise device and which may be quickly disassembled into its constituent components for storage or transport space, the disassembled components occupying a minimum of space, the set of components including two aquatic dumbbell members threadedly engaging a barbell shaft, each of the aquatic dumbbell members having a hand grip portion thereon provided near the intersection of two engageable half portions, each half portion having a planar surface constituting a fin extending radially outwardly therefrom, the two half portions being mutually engageable with each other such that, when engaged together, the half portions define a dumbbell having a plurality of fins extending radially outwardly from the hand grip portion, the fins being displayed at different angles to each other.

Still yet another object of the present invention is to provide hydrodynamic exercise equipment in which two water engagement members are removeably attached to opposite ends of the assembly and in which the water engagement members include two interlocking members which engage each other along an axis of the assembly, each of the interlocking members including a planar fin portion and an elongated shaft portion disposed centrally therein, the shaft engagement portions engaging each other such that the planar fin portions extend radially outwardly therefrom along different radial directions to define a plurality of water-resistance surfaces of the assembly.

SUMMARY OF THE INVENTION

In accordance with these and other objects, the present invention provides a new and improved aquatic exercise equipment assembly of modular construction which when assembled, forms an aquatic barbell and which may be disassembled into a pair of aquatic dumbbells and a gripping shaft, the entire assembly occupying a minimum of space when disassembled for storage and transport.

More particularly, and in accordance with the preferred embodiment, the exercise assembly comprises an elongated gripping bar having two water engagement portions removeably engaged thereto at opposite ends thereof by way of threaded connections. Each of the water engagement members constitute an aquatic dumbbell standing alone and when separated from the gripping bar, each dumbbell including an elongated central shaft portion with a hand grip portion defined thereon. The elongated shaft portion includes a plurality of planar fins extending radially outwardly from the shaft portion at different angular orientations such that planes defined by the fin portions intersect each other within the shaft. The planar fins further include interior open portions which are aligned together and which cooperate to define a clearance around the shaft hand grip portion so as to permit a user to reliably grip the hand grip portion of the dumbbell.

In accordance with the preferred embodiment of the present invention, the aquatic dumbbells are further assembled from two interengaging subcomponents which, when disassembled, have a minimum thickness such that the subcomponents may be positioned flat for transport or storage. Each of these interengaging subcomponents include a longitudinal slot extending through the planar fin portion and into the shaft portion at the hand grip area to provide a means for the two portions to engage each other to form the aforementioned aquatic dumbbell. The slots further provide the means for the two subcomponents to operatively engage each other in a manner such that the water engagement surfaces of the planar fin portions are angularly disposed with respect to each other.

Furthermore, in accordance with the preferred embodiment of the present invention, the gripping bar may include an elongated elastic resistance element attached to the bar which defines an elastic loop for a user to apply additional resistance to the exercise equipment assembly. These and other objects, features advantages of the present invention will be clearly understood through a consideration of the following detailed description.

BRIEF DESCRIPTION OF THE DRAWINGS

In the course of this description, reference will be made to the attached drawings in which.

DETAILED DESCRIPTION OF THE PREFERRED EMBODIMENT

Figure 1:
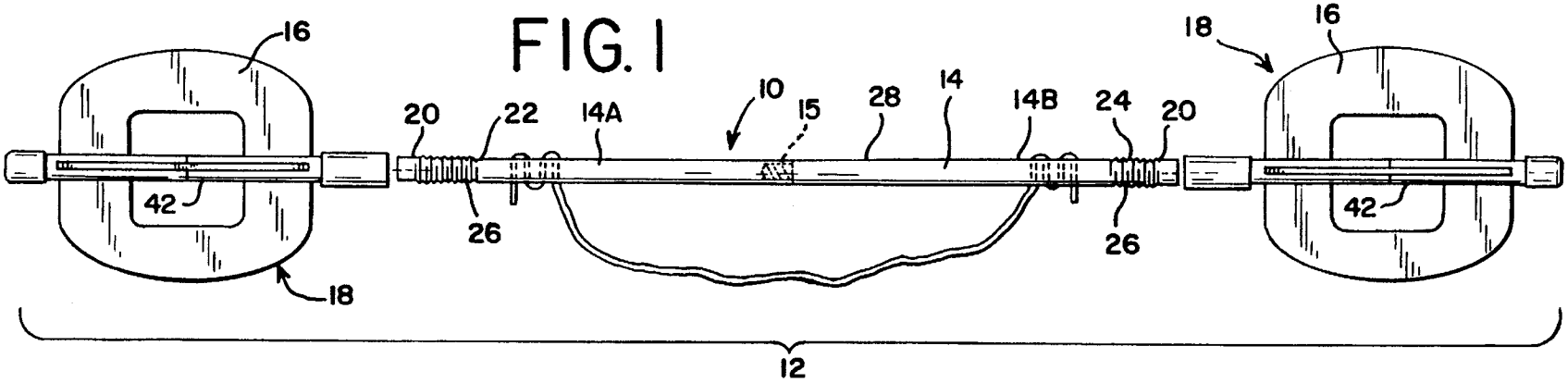
FIG. 1 is a view of a modular aquatic exercise equipment assembly, partially exploded, constructed in accordance with the principles of the present invention.

Referring now to the drawings, and in particular, to FIG. 1, a modular aquatic exercise assembly 10 is illustrated as an aquatic barbell 12 having an elongated gripping bar 14 with two opposing water-resistance members 16 disposed at opposite ends of the shaft 14 which define a pair of aquatic dumbbells 18 when separated from the gripping bar 14. The barbell 12 may be used comfortably in water for weight/resistance training purposes by users without undue stress being applied to any of the joints of the user.

In an important aspect of the present invention, the exercise assembly 10 is of a modular, or "knock-down" nature which permits it to be easily assembled in a minimum amount of time and also importantly, to be disassembled quickly into its constituent parts which occupy a minimum amount of space for transport and/or storage. In this regard, the gripping bar 14 may be of a hollow, tubular construction and utilize end caps 20 disposed at opposite ends of the bar 14 to seal the bar 14 and to provide the shaft with a measure of flotation. The outer portions 22, 24 of the opposite ends of the bar 14 may be provided with a series of threads 26 formed in the exterior surface 28 of the bar for providing a means to engage the water-resistance members 16.

Figure 2:
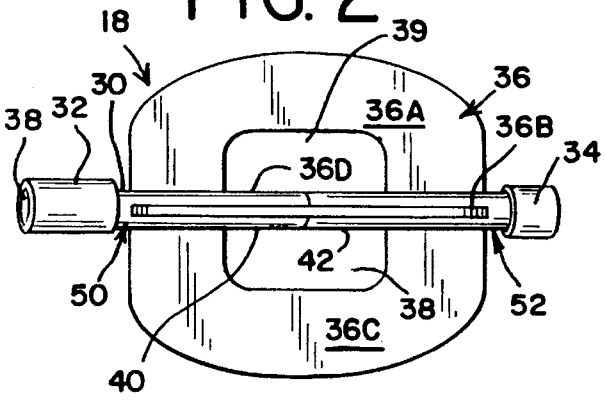
FIG. 2 is an elevational view of one of the water resistance members of the aquatic exercise equipment assembly of FIG. 1 which forms an aquatic dumbbell when separated from the gripping bar.

A typical water-resistance member 16 used with the gripping bar 14 is illustrated in FIG. 2 and can be seen to possess a central elongated shaft portion 30, an engagement collar 32 disposed at one end of the member 16 and an end cap 34 disposed at the opposite end of the shaft 30. The member 16 also includes a plurality of planar fins or blades, indicated generally at 36 and specifically at 36A–D. The interior surface of the engagement collar 32 may include a plurality of threads 38 which are adapted to engage the gripping shaft exterior threads 26. Preferably, for ease of assembly, and to prevent either of the two water-resistance members 16 from working off of the bar 14, the shaft exterior threads 26 at the opposing ends are reversed such that the water-resistance member 16 are threaded onto the gripping bar 14 with opposite rotations, i.e., if the left water-resistance member threads onto the gripping shaft in a clockwise manner, the right water-resistance member will thread onto the gripping shaft counterclockwise. (FIG. 1.)

The gripping bar 14 may include two interconnecting portions 14A, 14B joined together at the center of the bar as illustrated using a suitable interconnecting means, such as a threaded connection 15.

Returning to FIG. 2, it can be seen that each planar fin 36 extends radially outwardly from the shaft 30 of the water-resistance member 16. The planar fins 36 preferably have a length and radial extent which defines a sufficiently large planar surface area which functions as a hydrodynamic resistant surface against which water impinges when the member 16 is submerged in water. Desirable results have been obtained with lengths of about 12 inches and radial extents of about 5 inches leading to a hydrodynamic resistant surface area of about 38 square inches.

The planar fins 36 further may include a central opening 39 which surrounds a central portion 40 of the shaft 30 and also serves as a hand grip portion 42 for the dumbbell 18. These openings 39 permit a user to utilize the water-resistance member 16 as an individual aquatic dumbbell 18. In this regard, the openings 39 are sufficiently large to enable the user to easily slip his entire hand through the opening to reliably grip the dumbbell.

Figure 4:
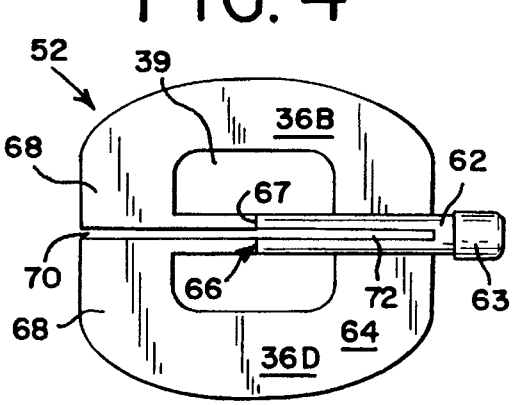
FIG. 4 is a plan view of the other of the two interengaging components which define the water resistance member of FIG. 2.
Figure 3:
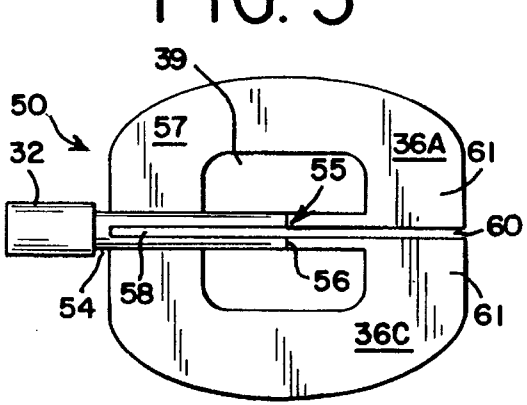
FIG. 3 is a plan view of one of the two interengaging components which cooperate to define the water resistance member of FIG. 2.

In another important aspect of the present invention, each water engagement member 16 is formed from two interengaging handle-fin components 50, 52, shown respectively in FIGS. 3 and 4. One of the components 50, illustrated in FIG. 3, includes a half-shaft portion 54 which extends from the engagement collar 32 for approximately one-half the length of the dumbbell 18. The half shaft portion 54 terminates in an open end 55 having a transverse face 56 which is disposed in about the center of the hand-accommodating openings 39 of the barbell 18. The planar fins 36A, 36C extend radially outwardly from the half-shaft portion 54 at opposing sides thereof and reenter the half-shaft 54 at its open end 55 through the half-shaft engagement slot 58.

The two planar fins 36A, 36C of the handle fin component 50 may be formed as a single member 57 of a predetermined thickness as illustrated in FIG. 3 and inserted into the half-shaft portion 54 by inserting the member 57 into a longitudinal slot 58 disposed in the half-shaft portion 54. The member 57 may then be affixed to the half-shaft portion 54 in a suitable manner such as by adhesive, solvent welding, plastic welding or the like. Alternatively, it is contemplated that the entire handle-fin component 50 may also be formed as a single piece by a conventional injection molding process. Another slot 60 is preferably disposed between the planar fins 36A, 36C in alignment with the longitudinal axis of the water engagement member 16 and the half-shaft portion 54 to accommodate the other component 52, as will be explained below. This slot 60 defines free ends 61 of the two planar fins 36A, 36C.

The other component 52 (FIG. 4) of the water engagement member 16 also includes a half-shaft portion 62 which terminates in an end cap 63. This half-shaft portion 62 has a fin member 64 which contains two planar fins 36B, 36D, which extend radially outwardly therefrom in the same manner as described above for handle-fin component 50. The fin member 64 is received in the half-shaft portion 62 at an open end 66 thereof which is defined by a transverse face 67. The free ends 68 of the planar fins 36B, 36D are separated by an engagement slot 70 which extends along the longitudinal axis of the fins 36B, 36D and half-shaft portion 62. This slot 70 terminates at about the open end 66 of the half-shaft portion 62 and is preferably aligned with a similar engagement slot 72 in the body of the half-shaft portion 62. In the preferred embodiment, the lengths of the engagement slots 58, 60 and 70, 72 of the two handle-fin components 50, 52 are approximately equal.

Figure 5:
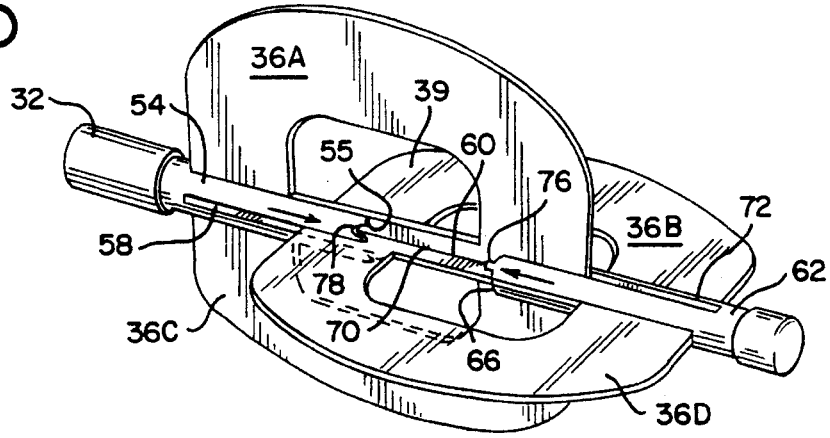
FIG. 5 is a partially exploded view of the water end portion of FIG. 2, illustrating how the two components interengage each other.

Turning now to FIG. 5, the manner in which the two handle-fin components 50, 52 engage each other to form the water-resistance member 16 barbell is illustrated. The planar fins 36A, 36C of the first handle-fin component 50 are oriented angularly with respect to the planar fins 36B, 36D of the second handle-fin component 52, (preferably at right angles to each other) and the planar fin slots 60 and 70 of the two components are also aligned. Once aligned, the two handle-fin components 50, 52 are slid toward each other as illustrated so that the free ends 61, 68 of the planar fin enter their respective opposing half-shaft portion engagement slots 58, 72 until their opposing end faces 56, 67 abut each other as shown. In order to provide a reliable joint between the two handle-fin components 50, 52, the engagement slots 58, 72 of the two respective half-shaft portions 54, 62 may have a thickness slightly less than the thickness of the planar fins 36 to provide a reliable frictional engagement therebetween. Alternatively, as shown in FIG. 5, one of the two half-shaft end faces 66 may be provided with an engagement means, which engages a portion of the opposing half-shaft end 55, such as the knob 76 and notch 78 illustrated.

When the two handle-fin components 50, 52 are slid apart to break down the dumbbell 18, the maximum thickness of each handle-fin component 50, 52 will be generally equal to the diameter of either the half-shaft portions 54, 62 or the engagement collar 32. Thus, it can be readily appreciated that the present invention, when disassembled into its constituent parts, requires a minimum of space for storage and transport. A user may thus pack the dumbbells in a suitcase for easy transport so that he has the exercise equipment available to him for business or pleasure trips.

Figure 6:
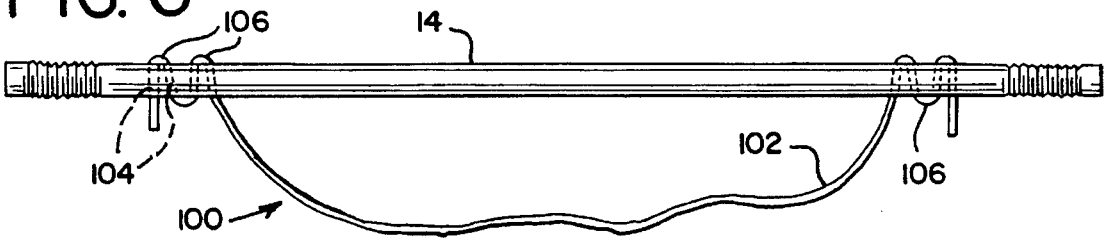
FIG. 6 is an elevational view of the gripping bar of the aquatic exercise equipment assembly of FIG. 1 with a resistance band in place; and, FIG. 7 is a view of an individual utilizing the modular aquatic exercise equipment assembly of FIG. 1.

In an alternative embodiment, the gripping bar 14 may include an elongated elastic resistance member 100 such as the elastic tubing 102 illustrated in FIG. 6 to provide the present invention with an additional means of resistance when submerged. The elastic band 102 preferably engages the gripping bar 14 by extending through a series of holes 104 formed therein proximate to the threaded end portions 26 of the bar. Multiple engagement holes 104 are preferably provided to form a series of elastic band loops 106 to ensure a reliable connection and decrease the likelihood of the resistance band 102 working itself free during exercise.

Figure 7:
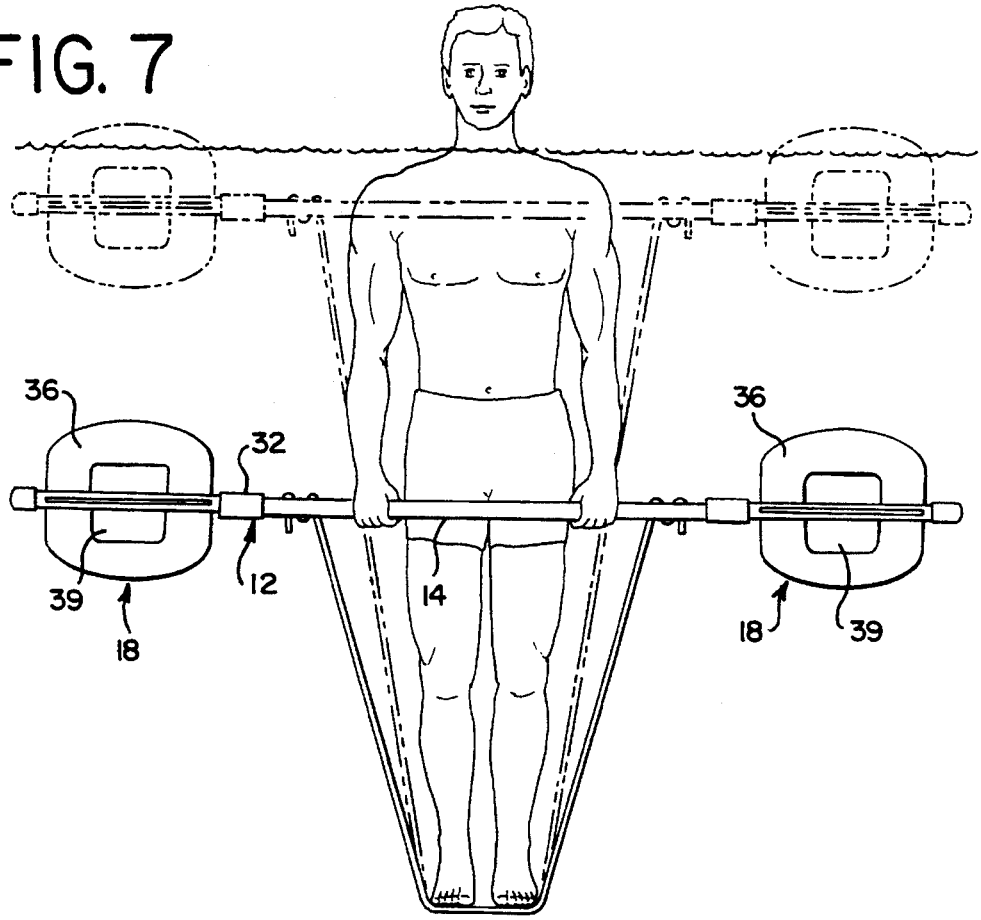

In use, as illustrated in FIG. 7, a user may grip the bar 14 and submerge it in the water and then engage the resistance member 100 with his feet. The user then lifts the bar up to the elevation shown in phantom and repeats the movement. The water impinges against the planar fins 36 of the water-resistance members 16 to provide a hydrodynamic resistance force. An additional resistance force is also supplied by the elastic band 102.

It will be appreciated that the embodiments of the present invention which have been discussed are merely illustrative of some of the applications of this invention and that numerous modifications may be made by those skilled in the art without departing from the true spirit and scope of this invention.

I claim:

1. Modular aquatic exercise equipment assembly, for performing exercises in water, comprising:

an elongated shaft for gripping by a user in performing said exercises;

a pair of water-resistance members removeably attached to opposite ends of the shaft, the water-resistance members cooperating with said shaft, when attached to said shaft to define an aquatic barbell, each water-resistance member providing an aquatic dumbbell when removed from said shaft;

each of said water-resistance members including a shaft portion and a plurality of apertured planar fin-portions extending radially outwardly from the shaft portion, said shaft portions providing a means for the user to grip said water resistance members, the planar fin-portions providing a plurality of hydrodynamic resistance surfaces for said water-resistance members which confront water when submerged and create a pressure head as the resistances surfaces are moved in water by the user, said planar fin-portions including centrally disposed openings in said fin-portions disposed adjacent said shaft portions, said planar fin-portion openings of each water-resistance member cooperating to define areas adjacent to said shaft portions at which the user may grip said shaft portions without interference with said planar fin-portions during exercise, each of said water resistance-members including first and second handle-fin components which cooperatively engage each other to define said water resistance-member, each of said handle-fin components including a half-shaft portion extending in alignment along a longitudinal axis and a pair of apertured planar fin members extending radially outwardly from said half-shaft portions.

2. Modular aquatic exercise equipment assembly as defined in claim 1, wherein each of said handle-fin component half-shaft portions include a engagement face extending transverse to said longitudinal axis, said half-shaft portions each including an elongated engagement slot therein extending longitudinally rearwardly from said transverse engagement face in general alignment with said longitudinal axis, the engagement slot of the first handle-fin component receiving a portion of the second handle-fin component, and the engagement slot of said second handle-fin component half-shaft portion receiving a portion of said first handle-fin component.

3. Modular aquatic exercise equipment assembly as defined in claim 1, wherein said elongated shaft is formed from two interlocking members.

4. Modular aquatic exercise equipment assembly as defined in claim 1, further including elastic resistance means extending from said shaft.

5. Modular aquatic exercise equipment assembly as defined in claim 2, wherein said half-shaft portion engagement slots have a thickness which is less than a thickness of said planar fin members which are received in said slots.

6. Modular aquatic exercise equipment assembly as defined in claim 1, wherein each of said water-resistance members includes means for removeably attaching said water-resistance members to opposing ends of said gripping shaft, each said water-resistance member further being formed from a pair of handle-fin components, each handle-fin component including a planar fin member having a longitudinal slot which defines two planar fin portions thereof, and a half-shaft portion defining a longitudinal axis of said handle-fin component, a portion of the planar fin member being received within said half-shaft portion and said planar fin portions of said planar fin member extending radially outwardly from said half-shaft portion, each half-shaft portion further including a transverse face, the transverse faces of said pair of handle-fin components abutting one another when said pair of handle-fin components are engaged to form said water-resistance member.

7. Modular aquatic exercise equipment assembly as defined in claim 6, wherein each of said handle-fin components includes proximate to said transverse faces, means for engaging two of said handle-fin components together.

8. Modular aquatic exercise equipment assembly as defined in claim 6, wherein each of said half-shaft portions includes a longitudinal slot extending along said longitudinal axis and opening at said transverse face, said slot being adapted to receive said planar fin portions of an opposing handle-fin component therein.

9. Modular aquatic exercise equipment assembly as defined in claim 6, wherein each of said handle-fin components have a generally planar profile standing alone and have a maximum thickness equal to about the diameter of the half-shaft portion.

10. In an aquatic exercise device having a gripping bar and two water-resistance members disposed at opposite ends of the gripping bar, wherein the water-resistance members include a plurality of apertured planar fins extending radially outwardly from a body portion, the planar fins being circumferentially disposed around the body portion such that, when viewed from an end of said water-resistance member, each of said planar fins are angularly offset from one another, said planar fins further defining a plurality of water-resistance surfaces, the improvement comprising:

each said water-resistance member being of a modular construction and formed from two cooperating components engageable along a longitudinal axis, each of the components including a half-body portion and at least one planar fin extending radially out from the half-body portion, said two components further including a slot in the half-body portions thereof, the half-body portion slot of one component receiving a portion of the planar fin of the other component, the half-body portion slot of said other component receiving a portion of said planar fin of said one component, whereby, when said two components are disassembled, each said component presents a generally flat profile having a thickness equal to a maximum diameter of said half-body portion, and whereby, when said two components are assembled to form a water-resistance member said planar fins extend from said half-body portion at predetermined angles from each other.

11. The aquatic exercise device of claim 10, wherein each of said water-resistance members includes means for detachably engaging said gripping bar.

12. The aquatic exercise device of claim 10, wherein said water-resistance members are injection molded.

13. The aquatic exercise device of claim 10, wherein each of said planar fins includes a central opening within said fin adjacent said half-body portion which is large enough to receive the hand of a user therethrough without interference with said planar fin.

14. The aquatic exercise device of claim 10, wherein said water-resistance member body portion constitutes an elongated shaft and each of said water-resistance member component half-body portions forms a half-shaft portion, each half-shaft portion having a transverse endface, the transverse endfaces of said half-shaft portions of each water-resistance member abuttingly engaging each other when said water-resistance component planar fins are received within said body portion slots.

15. The aquatic exercise device of claim 10, wherein each of said water-resistance member component planar fin includes a longitudinal slot aligned with said body portion slot, the fin slot defining two planar portions of said fin disposed on opposite sides of said body portion.

16. The aquatic exercise device of claim 14, wherein each of said body portions includes a transverse endface, said fin slots terminating near said endfaces.

17. The aquatic exercise device of claim 16, wherein said transverse endfaces include means for holding said two water-resistance member cooperating components in engagement.

18. Aquatic exercise equipment of modular construction, comprising an aquatic barbell having a gripping shaft and two water-resistance members disposed at opposite end portions of the gripping shaft, the two water-resistance members being detachable from said shaft end portions and each of said two water-resistance members serving as an aquatic dumbbell when detached from said gripping shaft, each of said water-resistance members having an elongated central shaft portion with a hand grip portion defined thereon, the central shaft portion having a plurality of fins extending radially from said central shaft portion at different circumferential angular orientations such that planes defined by fins intersect each other within said central shaft, said fins further including interior open portions extending partially along said shaft, the open portions of said fins being aligned and cooperating to define a clearance area around said hand grip portion so as to permit a user to grip said hand grip portion without interfering with said fins, said water-resistance member further including two handle-fin subcomponents having a half-shaft portion and a fin-portion, each handle-fin subcomponent having a longitudinal slot extending through the fin-portion thereof and into the half-shaft portion thereof, whereby said fin-portions are received within said slots such that said two handle-fin subcomponent half-shaft portions are aligned along a longitudinal axis to define said water-resistance member central shaft portion.

19. Aquatic exercise equipment of claim 18, wherein each of said handle-fin subcomponents, when disassembled, presents a generally planar profile having a thickness which is about equal to a diameter of said water-resistance member central shaft portion, whereby when said handle-fin subcomponents are stored or transported, they take up a minimum of space.

20. Aquatic exercise equipment of claim 17, wherein planar fin portions have a thickness which is at least slightly greater than a thickness of said longitudinal slots.

21. Modular aquatic exercise equipment assembly as defined in claim 1 wherein said central openings of said apertured fin-portions are large enough to permit a user to grasp said shaft within said planar fin-portions.

22. An aquatic exercise device of modular construction comprising a water-resistance member having a shaft portion and a series of apertured fin-portions extending radially outwardly from the shaft portion at different circumferential angular orientations, the apertured fin portions including central openings extending along said shaft portions, the openings being aligned so as to define a central clearance area encompassing part of said shaft portion by which a user may grip said shaft part without interference by said fin-portions, said water-resistance member further including two handle-fin subcomponents each having a half shaft portion and a fin-portion, each of the handle-fin subcomponents having a longitudinal slot extending through the fin-portion and into said half-shaft portion thereof, whereby said fin-portions are received with said slots such that said two handle-fin subcomponent half-shaft portions are aligned along a longitudinal axis to define said water-resistance member shaft portion.

* * * * *